US005319825A

United States Patent [19]

Fanning

[11] Patent Number: 5,319,825

[45] Date of Patent: Jun. 14, 1994

[54] CONCRETE TROWEL EXTENSION

[76] Inventor: Terry L. Fanning, 903 Blaine Ave., Janesville, Wis. 53545

[21] Appl. No.: 709,201

[22] Filed: Jun. 3, 1991

[51] Int. Cl.[5] ..... B05C 17/10; E01C 19/12

[52] U.S. Cl. ..... 15/235.4; 15/145

[58] Field of Search ..... 15/236.01, 145, 235.4–235.5, 15/235.8, 235.6; 16/114 R; 294/57; 172/371; 51/205 R

[56] References Cited

U.S. PATENT DOCUMENTS

| | | | |
|---|---|---|---|
| 1,763,066 | 6/1930 | Rooney | 16/114 R |
| 1,955,101 | 4/1934 | Sloan | 15/235.5 |
| 2,155,571 | 4/1939 | Tullis | 15/235.8 |
| 2,663,555 | 12/1953 | Milliken | 15/236.01 |
| 3,023,021 | 2/1962 | Fricke et al. | 294/57 |
| 3,341,235 | 9/1967 | Mattson et al. | 16/114 R |
| 4,197,764 | 4/1980 | Auernhammer | 16/114 R |
| 4,207,674 | 6/1980 | Heronema | 15/236.01 |
| 4,449,845 | 5/1984 | Carrillo | 15/235.4 |
| 4,656,566 | 4/1987 | Kelley | 16/114 R |
| 4,794,667 | 1/1989 | Nelson et al. | 16/114 R |
| 4,828,427 | 5/1989 | Nisenbaum | 15/235.4 |
| 4,886,297 | 12/1989 | Levine | 16/114 R |
| 4,911,575 | 3/1990 | Tidwell | 16/114 R |
| 5,048,883 | 9/1991 | Waluk | 294/57 |
| 5,065,475 | 11/1991 | Watt | 16/114 R |

FOREIGN PATENT DOCUMENTS

| | | | |
|---|---|---|---|
| 0660966 | 10/1936 | Fed. Rep. of Germany | 15/145 |
| 1311976 | 1/1962 | France | 294/57 |

*Primary Examiner*—Chris K. Moore
*Assistant Examiner*—James F. Hook
*Attorney, Agent, or Firm*—Lee, Mann, Smith, McWilliams Sweeney & Ohlson

[57] ABSTRACT

An extension for a concrete trowel The extension has a flat, upright frame with a pair of handles at the top for operating the frame and a trowel. A trowel is secured to the bottom of the frame by an adjustable clamp.

14 Claims, 2 Drawing Sheets

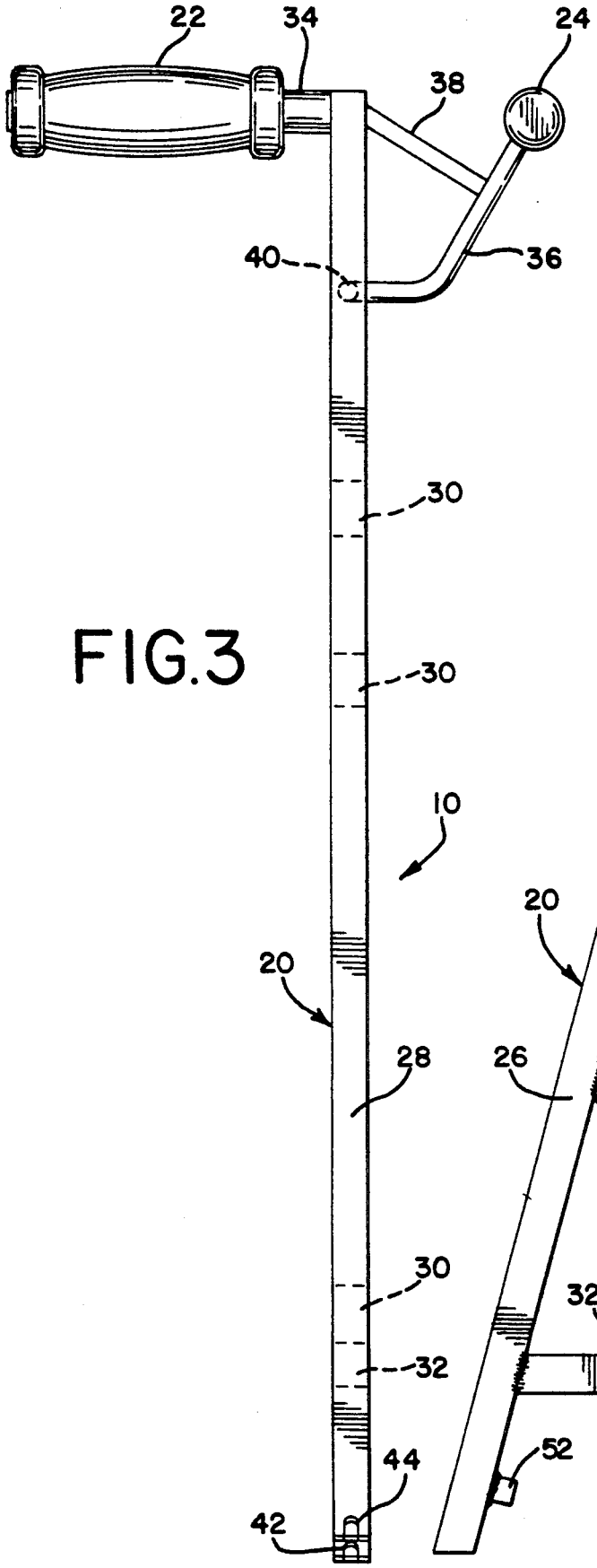
FIG.3
FIG.2
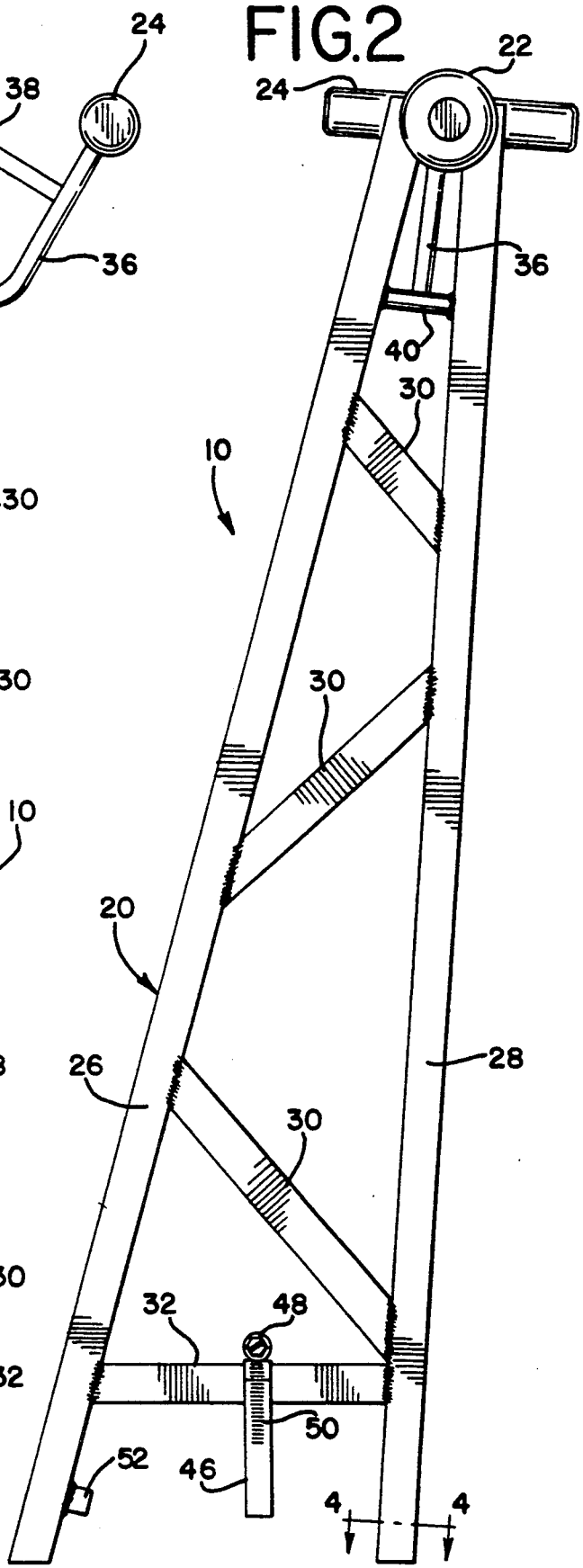

CONCRETE TROWEL EXTENSION

BACKGROUND OF THE INVENTION

This invention relates to concrete troweling apparatus, and in particular to an extension for a hand concrete trowel, which results in a trowel of great versatility and utility.

Hand troweling of concrete along edges of buildings or at columns is done in one of two manners, first either by utilizing knee boards when troweling, or second by simply bending over and troweling. In either process, a conventional hand trowel is used, the trowel comprising a flat blade with a handle secured thereto, the handle extending above and parallel to the length of the trowel. By judicious application of pressure through the handle to the trowel, appropriate pressure can be applied to still-plastic concrete for finishing the concrete surface.

Both current methods of hand troweling concrete have severe limitations. Knee boards are awkward to control, and when the concrete has hardened to a relatively stiff state, it is difficult to apply sufficient pressure to the trowel since the troweler is on his hands and knees, and thus is applying pressure substantially only through his arms and shoulders. Furthermore, many workers become arthritic as they age, and it is painful to kneel on knee boards with arthritic knees.

Bending over to trowel is even more physically demanding. This process, known in the industry as walking the wall, is one that only a minority of concrete finishers can perform. The finisher must be in excellent physical shape, and even so, considerable pressure is applied to the finisher's legs and back. Also, by bending over, the finisher compresses his chest cavity, thus leading to shortness of breath. Also, by bending over, blood tends to rush to the head, causing faintness in some individuals.

SUMMARY OF THE INVENTION

The invention overcomes the severe deficiencies of prior art process by providing an extension for a concrete trowel. The extension is composed of a flat, upright frame, handle means at the top of the frame comprising first and second handle portions located on opposite sides of the frame, and means at the bottom of the frame for securing the frame to a hand trowel.

In accordance with the preferred form of the invention, the first and second handle portions each comprise a grip secured to and extending from the frame. The grips are disposed substantially horizontally and at right angles to one another for proper control of the trowel. The handle portions are also located such that the center of gravity of the extension, when upright, lies substantially in the frame, thus balancing the invention to permit it to stand upright without additional support.

For securing a trowel to the frame, a clamp is provided about a lower cross bar in the frame. The clamp comprises an adjustable, expandable loop for engaging a trowel handle and holding the trowel in place on the frame. The frame is preferably formed from a pair of spaced legs, and each leg has a groove formed in the bottom thereof for engaging a rib typically found in a trowel. The grooves are thus aligned with one another in the frame.

BRIEF DESCRIPTION OF THE DRAWINGS

The invention is described in greater detail in the following description of an example embodying the best mode of the invention, taken in conjunction with the drawing figures, in which:

FIG. 2 is a side elevational view of the extension shown in FIG. 1 but without the concrete trowel, and with the extension tipped forwardly (to the left) slightly, FIG. 3 is an end elevational view, taken from the right in FIG. 2, showing the trowel according to the invention.

DESCRIPTION OF AN EXAMPLE EMBODYING THE BEST MODE OF THE INVENTION

Figures 1, 4, 5:
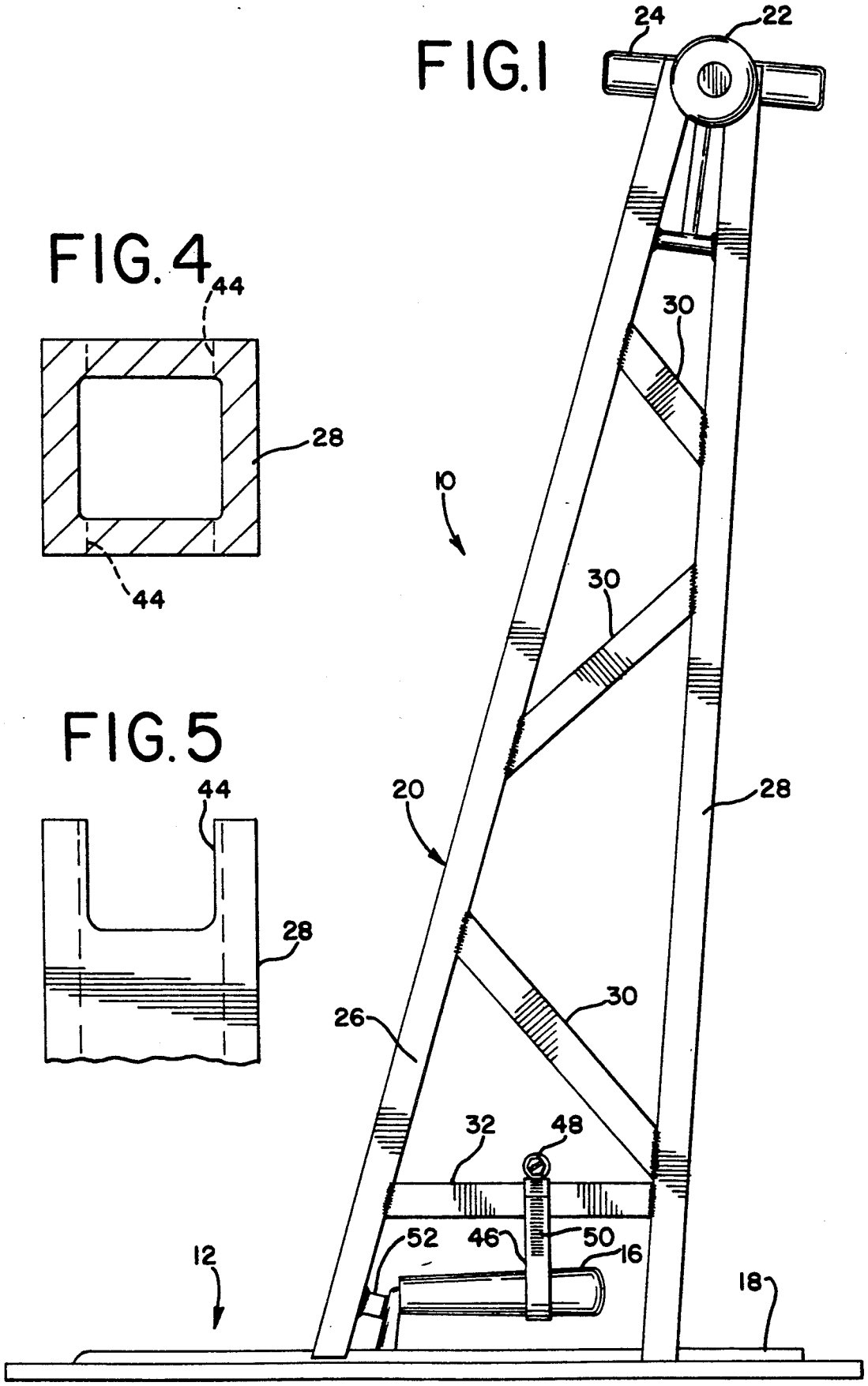
FIG. 1 is a side elevational view of an extension according to the invention, when secured to a concrete trowel.
FIG. 4 is an enlarged cross sectional view taken along lines 4—4 of FIG. 2.
FIG. 5 is a side view of the cross section shown in FIG. 4.

An extension according to the invention is shown generally at 10 in the drawing figures. In FIG. 1, the extension 10 is shown as attached to a conventional concrete hand trowel 12. The trowel 12 includes a flat troweling blade 14, which is typically rectangular and which has a handle 16 which is centrally attached to a longitudinal rib 18 extending a substantial portion of the length of the trowel 12. Rib 18 is used for strengthening purposes and force disbursement, and is typically welded or riveted to the troweling blade 14. The handle 16 normally is of wood, while the remainder of the trowel 12 is formed of metal. Other materials can be used, as well, and also the handle 16, which is shown parallel to the rib 18 and troweling blade 14, may be positioned at a greater or lesser height above the troweling blade 14, and may be disposed at some angle thereto. All such features of the trowel 12 are conventional, and form no direct part of the present invention.

The extension 10 is composed of a flat, upright frame 20, from which a pair of handles 22 and 24 extend. The frame 20 is composed of a pair of spaced, upright legs 26 and 28. The frame 20 is formed in a trusslike manner, having a series of spacing truss members 30 extending between the legs 26 and 28 periodically between the top of the frame 20 and a bottom cross bar 32. The frame 20 is preferably formed of aluminum or other some lightweight material, and the truss members 30 and cross bar 32 are welded to the legs 26 and 28, or otherwise appropriately permanently affixed thereto.

The handle 22 extends from a bar 34 secured to the top of the frame 20. Similarly, the handle 24 is secured to a support tube 36 and a brace tube 38 appropriately secured to the frame 20. As shown in FIGS. 1 and 2, the tube 36 is secured to a small cross bar 40 extending between the upright legs 26 and 28.

The handles 22 and 24 are located in approximately the same horizontal plane. As shown in the drawings, the handle 22 is disposed perpendicular to the handle 24 so that the user of the extension 10 can readily apply pressure to the trowel 12, either in the fore and aft directions, or to either side. Locating the handles in the orientation shown gives the finisher excellent control of the extension 10 in any direction.

The extension 10 is secured to the concrete hand trowel 12. For that purpose, the leg 26 includes a groove 42 formed at the bottom thereof for engaging the rib 18. Similarly, the leg 28 includes a groove 44 formed at the bottom thereof for engaging the rib 18. The grooves 42 and 44 are aligned with one another, as best shown in FIG. 3, which shows the frame 20 tipped slightly forwardly (to the left in FIGS. 1 and 2) to show both of the grooves 42 and 44.

A clamp 46 is used to secure the trowel handle 16 to the cross bar 32. The clamp 46 comprises an expandable loop which encompasses both the cross bar 32 and the handle 16. The clamp 46 is adjustable to accommodate various sizes and relative locations of a handle 16, adjustment being by means of a conventional rotatable worm 48 secured to the clamp 46 which engages slots 50 in the clamp for tightening or loosening the clamp as appropriate depending on the direction of rotation of the worm 48.

An abutment 52 is secured to the leg 26. As shown in FIG. 1, the abutment 52 butts against the handle 16 or a connecting extension thereof in order to align and hold the trowel 12 in place when connected to the extension 10.

The clamp 46, abutment 52 and aligned grooves 42 and 44 form a system in combination with the trowel 12 for securely attaching the trowel 12 to the extension 10. In some cases, the abutment 52 can be eliminated entirely. The size of the clamp 46 will depend on the size and relative height of the handle 16. The sizes of the aligned groove 42 and 44 will be dictated by the size of the rib 18.

FIG. 4 simply illustrates in cross section the leg 28, a cross section through the leg 26 being substantially identical. For lightness, as shown, the leg 28 is hollow. Were the legs 26 and 28 to be made from some other material, such as plastic, for the purposes of rigidity, the legs might be solid.

The height of the extension 10 may vary as desired. It has been found that an extension about two feet in height is optimal, accommodating finishers of different heights, and giving the finisher plenty of latitude for controlling the combined extension 10 and trowel 12 when troweling concrete.

ACHIEVEMENTS

The truss-type design of the frame 20 is strong, yet light. It is able to withstand pressure in any direction, and also abuse in construction projects.

With the use of the clamp 46 and grooves 42 and 44, the extension 10 will fit on any conventional trowel 12 without removing the handle 16 from the trowel, and will be held firmly in place without any chance of movement of the trowel 12 relative to the extension 10.

The combined system of the extension 10 and the trowel 12 permits the finisher to apply much more pressure than previously applicable to simply a trowel 12, and to apply that pressure much more accurately. With placement of the handles 22 and 24 perpendicular to one another, the finisher has excellent control of toe or heel pressure, or pressure to either side of the extension 10.

By having the handles 22 and 24 essentially balanced on either side of the frame 20, the center of gravity of the extension 10 falls in the frame 20. When the extension 10 is secured to a trowel 12, the system will thus stand upright without additional support.

Various changes can be made to the invention without departing from the spirit thereof or scope of the following claims.

What is claimed is:

1. An extension for a concrete trowel, comprising a. a flat, upright frame including a pair of spaced, upright legs, b. handle means at the top of said frame, said handle means comprising first and second handle portions located on opposite sides of said frame such that one handle portion projects from one side of said frame and the other handle projects from an opposite side of said frame, and c. means at the bottom of said frame for securing said frame to a trowel with said legs individually joining said trowel at spaced positions, said means for securing comprising a cross bar in said frame and a clamp carried by said cross bar, said clamp including means for engaging a trowel handle, each leg having a groove formed at the bottom thereof for engaging a trowel rib, said grooves being aligned with one another.

2. An extension according to claim 1 in which said first and second handle portions each comprise a grip secured to and extending from said frame.

3. An extension according to claim 2 in which said grips are disposed substantially horizontally and at right angles to one another.

4. An extension according to claim 3 in which said handle portions are located such that the center of gravity of the extension, when upright, lies substantially in said frame.

5. An extension according to claim in which said handle portions are located such that the center of gravity of the extension, when upright, lies substantially in said frame.

6. An extension according to claim 1 in which said clamp is adjustable.

7. An extension according to claim 1, in which said clamp comprises an expandable loop, said loop comprising said means for engaging a trowel handle.

8. An extension according to claim 7 including an abutment on one said leg in alignment with and for positioning a trowel when secured to said frame.

9. A concrete trowel having an extension for operating the trowel, comprising a. a flat, upright frame, including a pair of spaced, upright legs, b. handle means at the top of said frame, said handle means comprising first and second handle portions located on opposite sides of said frame such that one handle portion projects from one side of said frame and the other handle projects from an opposite side of said frame, and c. a troweling blade secured to the bottom of said frame with said legs individually joining said trowel at spaced locations, said trowel being removable from said frame, and including means for securing said trowel to said frame, comprising a cross bar in said frame and a clamp carried by said cross bar, said clamp including means for engaging a trowel handle, each leg having a groove formed at the bottom thereof for engaging a trowel rib, said grooves being aligned with one another.

10. A concrete trowel according to claim 9 in which said first and second handle portions each comprise a grip secured to and extending from said frame.

11. A concrete trowel according to claim 10 in which said grips are disposed substantially horizontally and at right angles to one another.

12. A concrete trowel according to claim 11 in which said handle portions are located such that the center of gravity of the extension, when upright, lies substantially in said frame.

13. A concrete trowel according to claim 9 in which said handle portions are located such that the center of gravity of the extension, when upright, lies substantially in said frame.

14. A concrete trowel according to claim 9 in which said clamp comprises an expandable loop, said loop comprising said means for engaging a trowel handle.

* * * * *